US011480187B2

(12) United States Patent
Kawashita et al.

(10) Patent No.: US 11,480,187 B2
(45) Date of Patent: Oct. 25, 2022

(54) OIL FIELD PUMP

(71) Applicant: MITSUBISHI HEAVY INDUSTRIES, LTD., Tokyo (JP)

(72) Inventors: Rimpei Kawashita, Tokyo (JP); Shimpei Yokoyama, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 274 days.

(21) Appl. No.: 16/794,368

(22) Filed: Feb. 19, 2020

(65) Prior Publication Data

US 2020/0378397 A1 Dec. 3, 2020

(30) Foreign Application Priority Data

May 31, 2019 (JP) ..... JP2019-102337

(51) Int. Cl.
*F04D 29/18* (2006.01)
*F04D 13/10* (2006.01)
(Continued)

(52) U.S. Cl.
CPC ..... *F04D 29/047* (2013.01); *E21B 43/128* (2013.01); *F04D 1/06* (2013.01);
(Continued)

(58) Field of Classification Search
CPC ..... F04D 1/06; F04D 13/10; F04D 29/046; F04D 29/047; F04D 29/0476; F04D 29/185; E21B 43/128; E21B 43/13; F16C 32/0629; F16C 32/0633; F16C 32/064; F16C 32/0655
See application file for complete search history.

(56) References Cited

U.S. PATENT DOCUMENTS 4,865,529 A * 9/1989 Sutton ..... F04D 13/04 417/409
5,462,364 A * 10/1995 Chandrasekaran ... F16C 17/028 384/111

(Continued)

FOREIGN PATENT DOCUMENTS

FR 2684149 A1 * 5/1993 ..... F01D 25/22
JP 2016-44673 4/2016

OTHER PUBLICATIONS

Machine translation of FR 2684149, Dominique et al, published May 28, 1993 (Year: 1993).*

*Primary Examiner* — Richard A Edgar
*Assistant Examiner* — Jason G Davis
(74) *Attorney, Agent, or Firm* — Wenderoth, Lind & Ponack, L.L.P.

(57) ABSTRACT

An oil field pump is installed within a pipe that connects to an oil field, and feeds accumulated extraction oil in a predetermined direction. The oil field pump includes a rotor with an impeller, a stator installed on the outer circumferential of the rotor and that forms a flow path for passing the extraction oil between the stator and the rotor and that includes a diffuser on the downstream side of the impeller, a static pressure bearing device installed between the rotor and the stator and that supports the load in the radial direction, and a supply flow path that supplies, to the static pressure bearing device, a portion of the extraction oil flowing along the inner side in the radial direction of the path.

2 Claims, 8 Drawing Sheets

(51) Int. Cl.

| | |
|---|---|
| ***F04D 1/06*** | (2006.01) |
| ***F04D 29/047*** | (2006.01) |
| ***E21B 43/12*** | (2006.01) |
| ***F04D 29/046*** | (2006.01) |

(52) U.S. Cl.
CPC ..... *F04D 13/10* (2013.01); *F04D 29/046* (2013.01); *F04D 29/185* (2013.01)

(56) References Cited

U.S. PATENT DOCUMENTS

| | | | | |
|---|---|---|---|---|
| 6,053,636 | A * | 4/2000 | Pelfrey | F04D 29/047 384/114 |
| 8,646,979 | B2 * | 2/2014 | Kashchenevsky | F16C 33/1075 384/118 |
| 10,823,177 | B2 * | 11/2020 | Sheth | F04D 7/02 |
| 2016/0053769 | A1 | 2/2016 | Mizukami et al. | |

* cited by examiner

OIL FIELD PUMP

CROSS-REFERENCE TO RELATED APPLICATIONS

The present application claims priority to and incorporates by reference the entire contents of Japanese Patent Application No. 2019-102337 filed in Japan on May 31, 2019.

FIELD

The present invention relates to an oil pump installed in oil fields.

BACKGROUND

Oil fields extract oil by way of oil field equipment including pipes connecting to positions where oil can be extracted and pumps installed within the pipes to feed the oil within the pipes. The pumps are installed within the fluid in the pipes and feed the oil within the pipes to the oil extraction port. The pumps feed oil extracted from oil fields and the fluid therefore sometimes contains foreign matter. The foreign matter mixes in between the rotating part and the stationary part and causes breakdown if the foreign matter accumulates as deposits. Japanese Patent Application Laid-open No. 2016-044673 A, for example, discloses a dynamic pressure bearing serving as a bearing for a pump to supply the fluid for feeding to an area between the rotating part and the stationary part.

Here, the oil field pump includes a pump body containing an impeller to compress and feed the extraction oil, and a motor that is connected to the pump body and serves as a drive source. The oil field pump further includes a bearing mechanism. Lubricating oil may be supplied to the bearing mechanism by installing supply lines for lubricating oil across the entire area of the pipes or by performing periodic maintenance. In contrast, when lubricating the bearing mechanism with the extraction oil as disclosed in Japanese Patent Application Laid-open No. 2016-044673 A, the foreign matter might possibly mix into the bearing mechanism for the extraction oil. The intrusion or mixing with foreign matter may cause breakdown and therefore more frequent maintenance is required. Moreover, unstable vibration of the bearing might occur in the oil field pump that speeds up abrasion and wears out the bearing. Narrowing the gap of the dynamic pressure bearing can suppress the unstable vibrations of the bearing but there is a limit to the extent the gap can be reduced. A smaller gap will also increase the possibility of breakdown due to foreign matter.

To resolve the aforementioned problems with the related art, the present invention has the objective of providing an oil field pump that maintains the gap clearance, supports the bearing with appropriate strength, suppresses unstable vibrations and is capable of reducing the need for frequent maintenance.

Solution to Problem

To achieve the above object, an oil field pump installed within a pipe that, connects to an oil field, the oil field pump being configured to feed accumulated extraction oil in a predetermined direction is disclosed. The oil field pump includes a rotor installed with an impeller, a stator installed on an outer circumference of the rotor and that forms a flow path for passing the extraction oil between the stator and the rotor and that includes a diffuser on a downstream side of the impeller, a static pressure bearing device installed between the rotor and the stator and that supports the load in a radial direction, and a supply flow path that supplies, to the static pressure bearing device, a portion of the extraction oil flowing along an inner side in the radial direction of the flow path.

It is preferable that the static pressure bearing device is installed between the diffuser and the rotor.

It is preferable that the static pressure bearing device is fixed to the stator and includes a pipe part extending in an axial direction of the rotor and a flange part installed on ends in a perpendicular direction of the pipe part and that protrudes to the rotor side, and a hole that connects to the supply flow path is formed on the pipe part.

It is preferable that the supply flow path connects the hole to a path further downstream than the diffuser.

It is preferable that the distance between the pipe part and the rotor part changes according to the position in a rotational direction.

It is preferable that the distance between the pipe part and the rotor becomes shorter, the further downstream from the hole in the rotational direction.

It is preferable that the distance between the pipe part and the rotor becomes continuously shorter, the further downstream from the hole in the rotational direction.

It is preferable that the hole tilts to the upstream side in the rotational direction of the rotor towards the inner side in the radial direction.

It is preferable that a plurality of the impellers are installed along the axial direction of the rotor, one static pressure bearing device is installed further downstream in the perpendicular direction than the impellers, and the supply flow path is formed in the interior of the rotor.

Advantageous Effects of Invention

The present invention is capable of reducing the need for frequent maintenance.

DETAILED DESCRIPTION OF THE INVENTION

Figure 1:
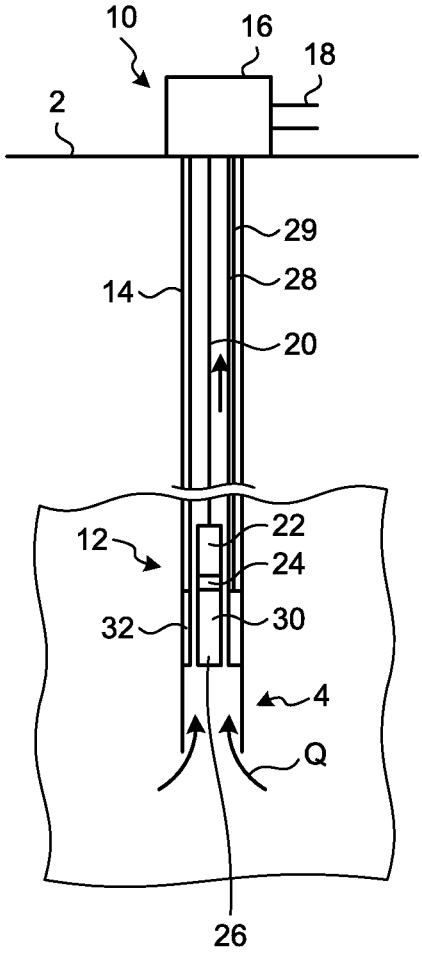
FIG. 1 is an overall structural view of an oil extraction device including an oil field pump of the embodiment of the present invention.

The embodiment of the present invention is described next while referring to the drawings. The present invention is not limited by the embodiment. The structural elements in the following embodiments can be easily substituted by one skilled in the art or may include essentially the same item.

FIG. 1 is an overall structural view of an oil extraction device including an oil field pump of the embodiment of the present invention. An oil extraction device 10 is installed on an installation surface 2. The installation surface 2 is a structure installed at an oil field 4. When the oil field 4 is on the ocean floor or in other words when the oil field 4 is an offshore oil field, the installation surface 2 is a structure at sea level. When the oil field 4 is below ground, the installation surface 2 is a structure at ground level. The oil field 4 is an area to accumulate the oil for extraction.

As illustrated in FIG. 1, the oil extraction device 10 includes a pump (oil field pump) 12, a pipe 14, a ground facility 16, and a guide pipe 18. The pump 12 is equipment that feeds the extraction oil Q accumulated in the oil field 4. The extraction oil Q might contain solid matter such as ores in addition to the crude oil. The pipe 14 is a flow path for the flow of extraction oil Q therein. One end of the pipe 14 is installed in the oil field 4 and the other end is connected to the ground facility 16. The pump 12 is installed at a section on the oil field 4 side in the pipe 14. The ground facility 16 includes a device to wind up a wire 20 such as a coil turbine or a wire winder mechanism described below. The guide pipe 18 guides the extraction oil Q.

The pump 12 includes a wire 20, a pump body 22, a coupler 24, a motor 26, a stationary pipe 28, and an electric cable 29. The pump body 22, the coupler 24, and part of the motor 26 (rotor 30 described below) are integrally connected in the pump 12. The upper end of the pump body 22 connects to the wire 20. The wire 20 can be wound up and fed out by the above described ground facility 16. The stationary pipe 28 fixes a stator 32 that is a portion of the motor 26. The extraction oil Q can flow within the interior of the stationary pipe 28. The electric cable 29 connects between the ground facility 16 and the stator 32 and supplies electrical power to the stator 32.

In the pump 12 of the present embodiment, the pump body 22, the coupler 24, and motor 26, are detachable from the electric cable 29. In other words, winding the wire 20 separates the pump body 22, the coupler 24, and the rotor 30 of the motor 26 as an integrated piece from the stator 32 and raises them upward within the stationary pipe 28. This structure can easily insert and pull up the pump body 22, the coupler 24, and the rotor 30 as an integrated piece so that installing a large scale rig or similar equipment at the installation surface 2 is not necessary.

The motor 26 includes the rotor (rotating part) 30 and the stator (stationary part) 32. The rotor 30 can rotate centering on the center axis. The rotor 30 includes a permanent magnet. The permanent magnet is mounted as one piece with the rotor 30 on the outer circumference of the rotor 30. The stator 32 includes an electromagnet. The electromagnet generates a magnetic field from the electrical power supplied from the electric cable 29. The interaction between the magnetic field generated from the electromagnet and the magnetic field generated from the permanent magnet allows rotation of the rotor 30 centering on the center axis.

The coupler 24 connects the motor 26 and the pump body 22. The coupler 24 couples the rotor 30 of the motor 26 with the rotor (rotating part) of the pump 12, and couples the stator 32 of the motor 26 with the stator of the pump 12. The pump 12 in this way drives the pump 22 using the motor 26 as a power source, and forms the flow of extraction oil Q towards the upstream side in perpendicular direction in the pipe 14.

Figure 2:
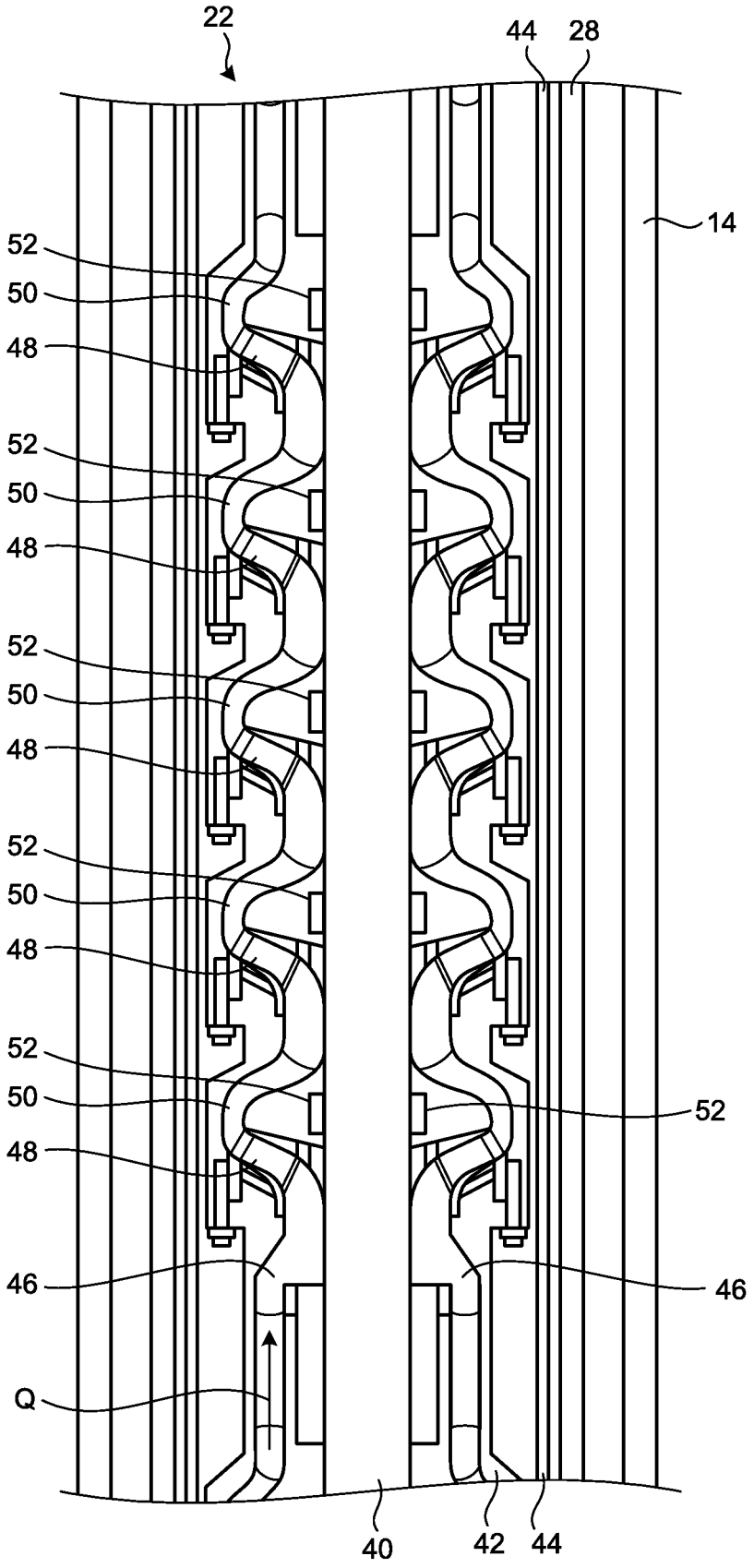
FIG. 2 is a fragmentary cross-sectional view illustrating a pump body of the oil field pump illustrated in FIG. 1.

The pump body 22 is described next while referring to FIG. 2. FIG. 2 is a fragmentary cross-sectional view illustrating a pump body of the oil field pump illustrated in FIG. 1. The pump body 22 is a multi-stage pump in which an impeller and a diffuser are provided in a plurality of stages on the flow path for the extraction oil Q. The pump body 22 includes a rotor 40, a stator 42, a casing 44, and a flow path 46. The casing 44 is an end (edge) along the outer side in the radial direction of the pump body 22 and couples to the stator 42. The outer side surface in the radial direction of the casing 44, faces opposite the stationary pipe 28. The flow path 46 is the passage for flow of the extraction oil Q. The flow path 46 joins the area formed by the rotor 40, the area with an inner circumferential surface formed by the rotor 40 and the outer circumferential surface formed by the stator 42, and the area formed by the stator 42.

The rotor 40 is the rotating part and rotates as one piece with the rotor 30 of the motor 26. A plurality of impellers 48 are installed on the outer side in the radial direction of the rotor 40. A plurality of blades (or vanes) are installed on the impeller 48 along the direction of rotation. The impellers 48 are installed at predetermined intervals along the axial direction. On the rotor 40, the vane (or blade) installed at the same position along the axial direction forms one stage, and the impeller 48 at each position in the axial direction forms the respective stage. The flow paths 46 on which the impellers 48 are installed, move to the outer side in the radial direction towards the downstream side of the flow direction of the extraction oil Q.

The stator 42 couples to the stator 32 of the motor 26 on the stationary part. A diffuser 50 is installed on the section forming the flow path 46 on the stator 42. A plurality of diffusers 50 are installed along the direction of rotation. The diffusers 50 are installed in the downstream side of the impellers 48 in the axial direction. The flow paths 46 on which the diffusers 50 are installed, move to the inner side in the radial direction towards the downstream side of the flow direction of the extraction oil Q. The stator 42 includes a static pressure bearing 52 on the inner side in the radial direction of the area forming the flow path 46 on the stator 42. The static pressure bearing 52 is described below.

In the pump body 22, a stator 42 is installed on the outer circumference of the rotor 40, and a flow path 46 is formed between the rotor 40 and the stator 42. The impellers 48 and the diffusers 50 are alternately installed in the flow path 46. By passing the extraction oil Q through the impellers 48 rotating by way of the rotation of the rotor 40, a rotational force in the rotational direction is applied on the extraction oil Q along with gradually applying a centrifugal force towards the outer side in the radial direction. The passage of the extraction oil Q through the diffusers 50 moves it to the inner side in the radial direction and converts the energy of the swirling component to pressure. By passing the extraction oil Q through the impellers 48 and the diffusers 50 in this way, the pump body 22 raises the pressure and in the present embodiment conveys the extraction oil Q to the upper side in a perpendicular direction.

Figure 3:
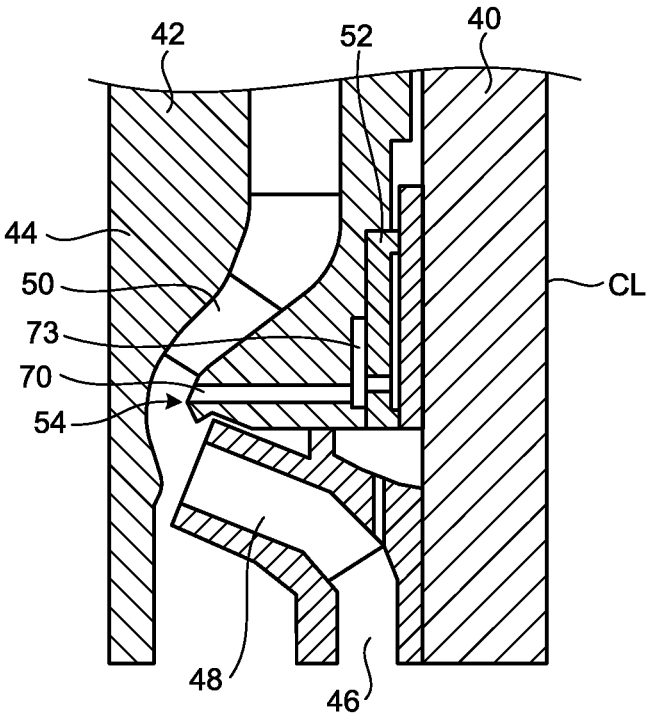
FIG. 3 is a cross-sectional view illustrating the structure of one stage of the pump body.
Figure 4:
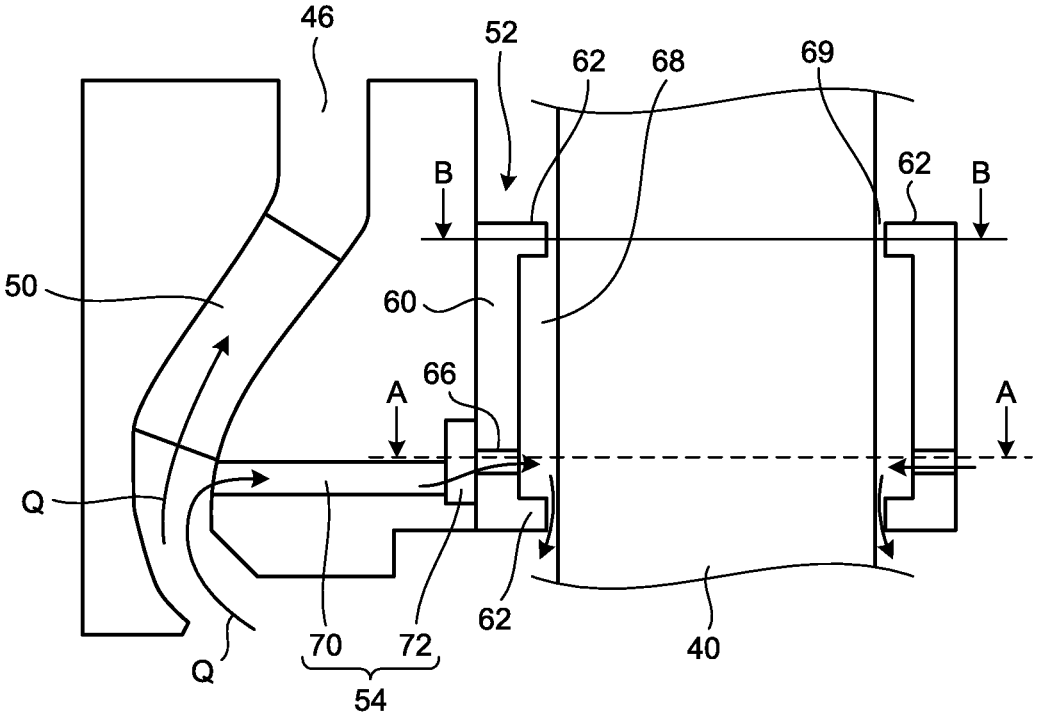
FIG. 4 is a schematic diagram illustrating the overall structure of a static pressure bearing and a supply flow path.
Figure 5:
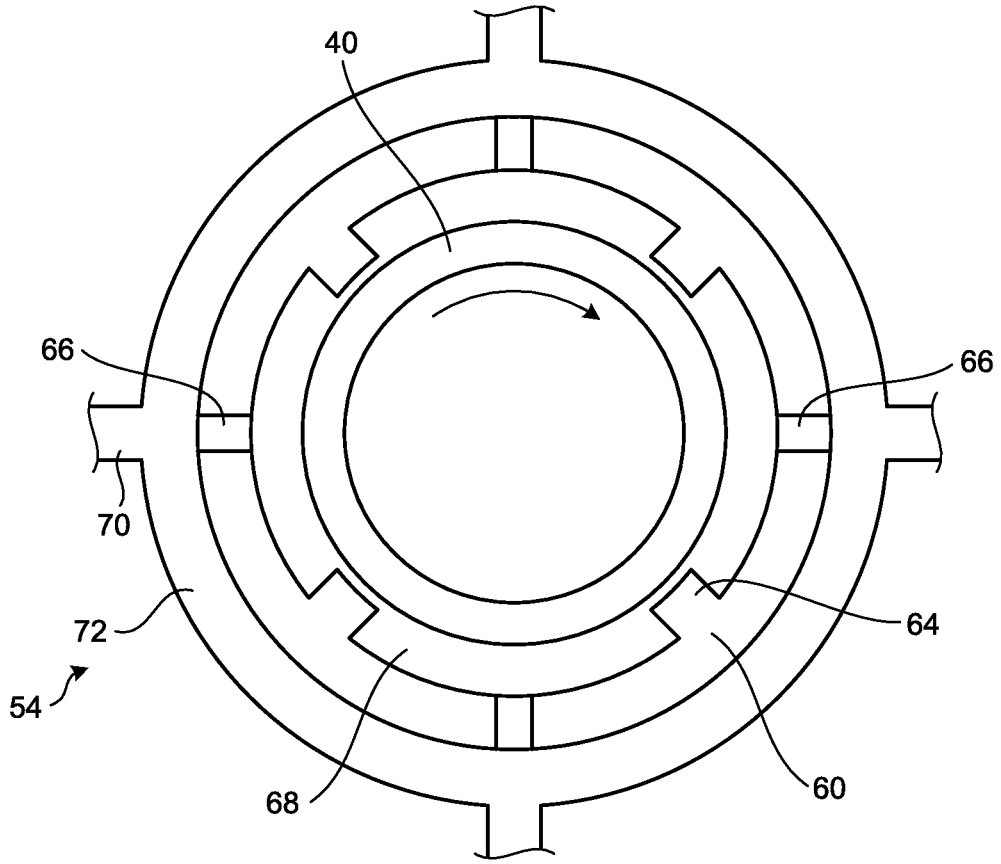
FIG. 5 is a cross-sectional view taken along line A-A of FIG. 4.
Figure 6:
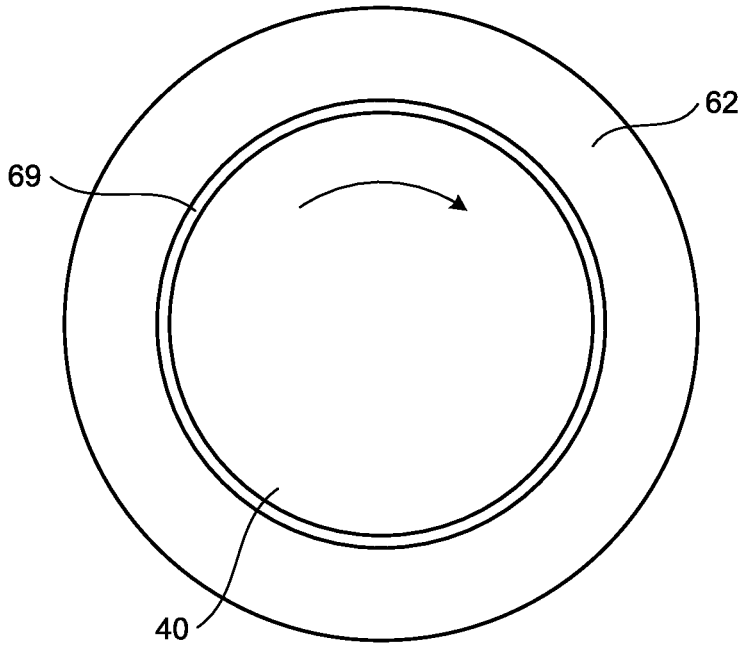
FIG. 6 is a cross-sectional view taken along line B-B of FIG. 4.

Next, the static pressure bearing 52 and the supply flow path 54 are described while referring to FIG. 3 through FIG. 6 in addition to FIG. 2. FIG. 3 is a cross-sectional view illustrating the structure of one stage of the pump body. FIG. 4 is a schematic diagram illustrating the overall structure of the static pressure bearing and the supply flow path. FIG. 5 is a cross-sectional view taken along line A-A of FIG. 4. FIG. 6 is a cross-sectional view taken along line B-B of FIG. 4.

The static pressure bearing 52 is installed on the inner edge surface in the radial direction of the stator 42 and faces opposite the rotor 40. The static pressure bearing 52 is fixed on the other area of the stator 42. The static pressure bearing 52 includes a pipe part 60, two flange parts 62, and a plurality of lands 64. The pipe part 60 is a hollow cylinder in the axial direction on the rotor 40 forming a spindle, its inner circumferential surface faces the rotor 40, and its outer circumferential surface is fixed on another area of the stator 42. A hole (oil path inlet) 66 is formed on a portion of the pipe part 60. A plurality of holes 66 are formed along the circumference, and in the present embodiment are formed at four positions along the circumference. The flange 62 is installed on both ends along the axial direction of the pipe part 60. The flange part 62 protrudes more to the rotor 40 side than the pipe part 60. The flange part 62 is a ring-shaped member formed along the entire circumference on the periphery (of the rotor 40). The two flange parts 62 are the same diameter on the inner circumference. The lands 64 are installed on the inner circumferential surface of the pipe part 60 and protrude toward the rotor 40 side. The lands 64 are installed on a portion of the periphery and extend in the axial direction. The area enclosed by the pipe part 60, the flange part 62, and the stator 40 forms a static pressure pocket 68 on the static pressure bearing 52. A bottleneck part 69 is formed between the flange part 62 and the stator 40 at a shorter distance than the static pressure pocket 68.

The supply pipe 54 supplies a portion of the extraction oil Q flowing in the flow path 64 to the static pressure pocket 68. The supply flow path 54 includes a path 70 and peripheral through holes 72. The path 70 is formed on an area more on the inner circumferential side than the path 46 of the stator 42. One end of the path 70 is open on the upstream side of the diffuser 50 of the flow path 46 and also on the downstream side of the impeller 48, and the other end thereof is open at the peripheral through holes 72. The flow path 70 of the present embodiment is formed at four positions along the circumference. The peripheral through holes 72 are empty spaces formed in a ring shape along the circumference, and connect to the ends on the inner circumferential side of the four flow paths 70. The peripheral through holes 72 connect to the holes 66. In the present embodiment, the peripheral through holes 72 are formed on the stator 42 but may be formed on the outer circumference of the static pressure bearing 52.

In the pump body 22, a portion of the extraction oil Q flowing in the flow path 46, flows into the path 70 formed on the inner side in the radial direction of the flow path 46, and flows into the peripheral through holes 72. The extraction oil Q flowing into the peripheral through holes 72, passes through the holes 66 and flows into the static pressure pocket 68. In the pump body 22, the extraction oil Q is supplied at a predetermined pressure from the supply flow path 54 to the static pressure pocket 68 enclosed by the pipe part 60, the flange part 62, and the stator 40. In the static pressure pocket 68, the hole 66 is the inlet for the extraction oil Q, and the bottleneck part 69 forms the outlet for the extraction oil Q. The bottleneck part 69 is smaller than the static pressure pocket 68, and therefore a the extraction oil Q is held within the static pressure pocket 68, and a predetermined pressure is maintained. In the pump body 22, by connecting the static pressure pocket 68 to an area further downstream than the impeller 48, the pressure of the extraction oil Q on the hole 66 side can be set higher than the pressure of the extraction oil Q at an area connecting to the bottleneck part 69 on the perpendicular downstream side. In the static pressure bearing 52, the extraction oil Q can in this way be supplied to the static pressure pocket 68 and maintained at a predetermined pressure, and the load in the radial direction (journal direction) of the stator 40 can be received.

As described above, in the pump body 22, by supplying a portion of the extraction oil Q to the static pressure bearing 52, lubricating oil can be supplied to the thrust bearing 50 without installing another separate circuit to supply lubricating oil. The bottleneck part 69 can be installed between the rotor 40 and the stator 42 by setting the static pressure bearing 52, so that solid material can be discharged even if solid material mixes into the extraction oil Q.

In the pump body 22, connecting the path 70 to the inner side in the radial direction of the flow path 46 allows the inflow of extraction oil Q in the inner side in the radial direction that moves by centrifugal force to the outer side in the radial direction. Applying a centrifugal force to the extraction oil Q moves the solid material in the outer side in the radial direction within the flow path 46 so that solid materials on the inner side in the radial direction decrease by a relative amount. The solid material in the inflow of the extraction oil Q into the supply flow path 54 can in this way be made more difficult and the penetration (mixing) of solid material into the static pressure pocket 58 of the static pressure bearing 52 can be suppressed. In the pump body 22, by supplying the extraction oil Q to the static pressure pocket 58, the static pressure bearing can receive the load, support the spindle with adequate rigidity (stiffness) along with maintaining the gap, and suppress unstable vibrations. The need for frequent maintenance of the static pressure bearing 52 can in this way be reduced.

In the pump body 22 of the present embodiment, by connecting the downstream side of the impeller 48 and also the upstream side of the diffuser 50, and the supply flow path 54, the components on the inner side in the radial direction of extraction oil Q in an area with a large swirling component can flow into the supply flow path 54. The swirling component is therefore large and the solid material concentrates in the outer side in the radial direction so the extraction oil Q can be obtained from an area on the inner side in the radial direction with little solid material. As seen in the present embodiment, in the supply flow path 54, the path 70 is open at the surface on the inner side in the radial direction of the flow path 46. In other words, the path 70 does not protrude into the flow path 46 so the extraction oil Q that is more to the inner side in the radial direction can flow into the path 70 and the solid material can be reduced to a small amount. Turbulence occurring due to the flow of the extraction oil Q in the flow path 46 can also be reduced. Therefore, the path 70 preferably does not protrude into the flow path 46, however the path 70 may protrude into the flow path 46.

In the pump body 22 of the present embodiment, a static pressure bearing 52 is installed at each stage of the diffusers 50. However, there is no limit to this arrangement. One static pressure bearing 52 may be installed for a plurality of diffuser 50 stages, or a plurality of static pressure bearings 52 may be installed for one stage of the diffuser 50.

Figure 7:
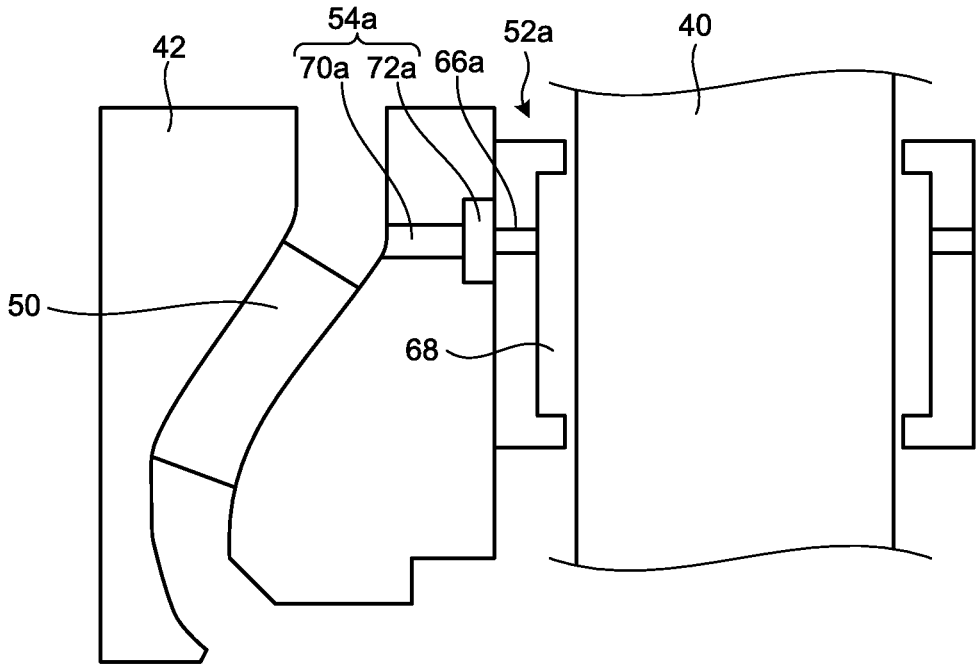
FIG. 7 is a schematic diagram illustrating the overall structure of another example of the static pressure bearing and the supply flow path.

FIG. 7 is a schematic diagram illustrating the overall structure of another example of the static pressure bearing and the supply flow path. The pump body illustrated in FIG. 7 is identical to the pump body 22 except for the supply path installation position. The pump body illustrated in FIG. 7 includes a static pressure bearing 52*a*, and a supply flow path 54*a*. In the static pressure bearing 52*a*, a hole 66*a* is formed corresponding to the position of the supply flow path 54*a*. The supply flow path 54*a* includes a path 70*a* and a peripheral through hole 72*a*. The path 70*a* of the present embodiment is open on the downstream side of the diffuser 50 on the flow path 46.

In the pump body illustrated in FIG. 7, opening the path 70*a* on the downstream side of the diffuser 50 allows supplying the extraction oil Q that passes through the diffuser 50 to the static pressure pocket 68. Therefore, the extraction oil Q at a higher pressure can be supplied to the static pressure pocket 68.

Figure 8:
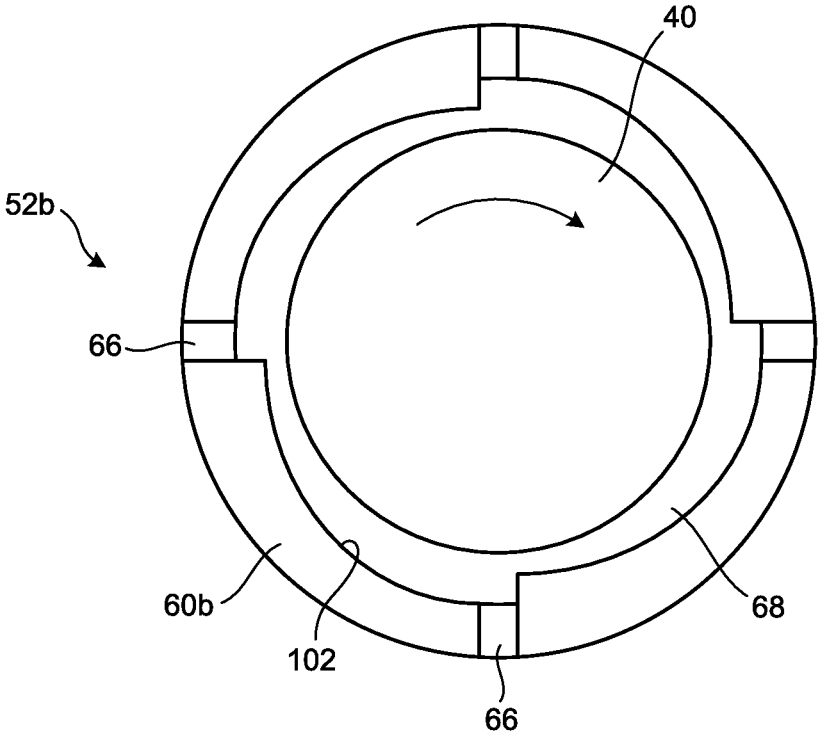
FIG. 8 is a cross-sectional view illustrating the overall structure of another example of the static pressure bearing.

The shape of the static pressure bearing 52 is not limited to the shape in the present embodiment and a variety of structures may be utilized. FIG. 8 is a cross-sectional view illustrating the overall structure of another example of the static pressure bearing. FIG. 8 is a cross sectional view taken along the same positions as line A-A in FIG. 4. In the static pressure bearing 52*b* illustrated in FIG. 8, the distance between an inner surface 102 of a pipe part 60*b* and the rotor 40 changes according to the position in the circumferential direction. Specifically, the inner surface 102 consecutively tilts in the direction approaching the rotor 40 in the rotational direction towards the downstream side from the position of the hole 66. The static pressure bearing 52*b* can include an offset bearing function by changing the distance between the inner circumferential surface 102 and the rotor 40 according to the position in the circumferential direction. The strength (rigidity) of the static pressure bearing 52*b* as a bearing can in this way be further increased. The supply of extraction oil Q from the hole 66 also stops. Even if the distance between the rotor 40 and the static pressure bearing 52*b* changes and the function of the static pressure bearing 52*b* cannot be maintained, the static pressure bearing 52*b* can still function as an offset bearing to receive the radial load.

Figure 9:
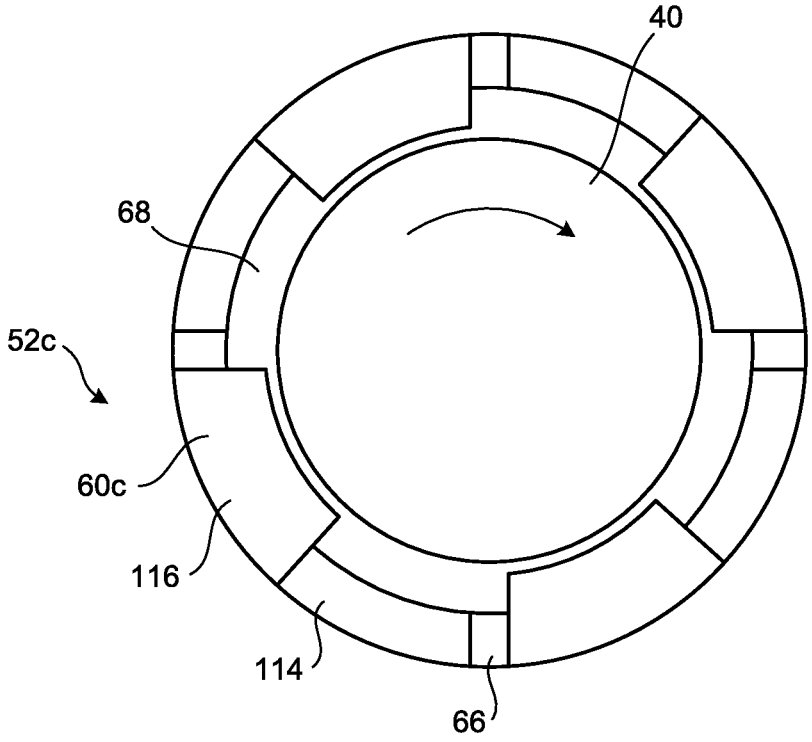
FIG. 9 is a cross-sectional view illustrating the overall structure of another example of the static pressure bearing.

FIG. 9 is a cross-sectional view illustrating the overall structure of another example of the static pressure bearing. FIG. 9 is a cross-sectional view taken along the same positions as line A-A in FIG. 4. In a static pressure bearing 52*c* illustrated in FIG. 9, the distance between an inner surface of a pipe part 60*c* and the rotor 40 changes according to the circumferential position. Specifically, the pipe part 60*c* includes a first area 114 and a second area 116 between the holes 66. The inner surfaces of the first area 114 and the second area 116 are an arc shape centering on the center of rotation. The second area 116 protrudes to the rotor 40 side more than the first area 114. In other words, the second area 116 has a smaller diameter on the arc on the inner surface than the first area 114. On the static pressure bearing 52*c*, the inner surface between the first area 114 and the second area 116 is a step shape, and the downstream side portion has a shape closer to that of the rotor 40 than does the upstream side in the rotation direction. Even in the case of this type of step shape (contour), the static pressure bearing 52*c* can include an offset bearing function by changing the distance between the inner surface and the rotor 40 according to the position in the circumferential direction. The strength (rigidity) of the static pressure bearing 52*c* as a bearing can in this way be further increased. The supply of the extraction oil from the hole 66 also stops. Even if the distance between the rotor 40 and the static pressure bearing 52*c* changes and the function of the static pressure bearing 52*b* cannot be maintained, the static pressure bearing 52*c* can still function as an offset bearing to receive the radial load.

Figure 10:
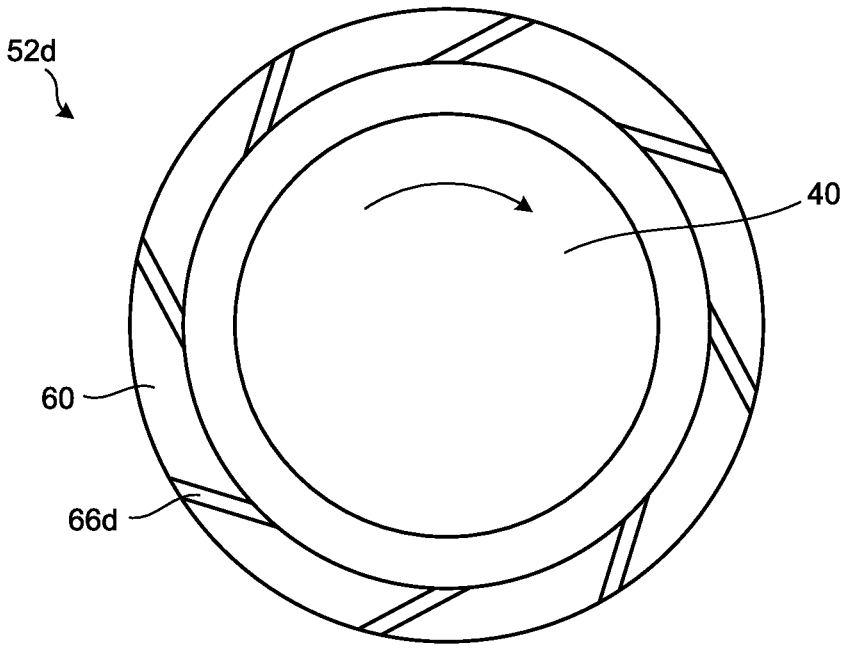
FIG. 10 is a cross-sectional view illustrating the overall structure of another example of the static pressure bearing.

FIG. 10 is a cross-sectional view illustrating the overall structure of another example of the static pressure bearing. FIG. 10 is a cross-sectional view taken along the same positions as line A-A in FIG. 4. In the static pressure bearing 52*d* illustrated in FIG. 10, a hole 66*d* formed in the pipe part 60 tilts toward the upstream side in rotational direction of the rotor 40, as it approaches the inner side in the radial direction. In other words, the hole 66*d* applies a tilted component to the side opposite the rotation direction, and the extraction oil Q is supplied to the static pressure pocket 68.

By supplying the extraction oil Q to the static pressure pocket 68 along with tilting the hole 66*d* and applying a component tilted to a side opposite the rotational direction, the static pressure bearing 52*d* can reduce the swirling flow occurring in the static pressure pocket 68 by rotation of the rotor 40. The swirling flow in the static pressure pocket 68 or specifically the swirling flow of the extraction oil Q passing the lands 64 can be reduced, and unstable vibration due to fluid excitation force (applied as a cross term for the stiffness coefficient) can be reduced.

Figure 11:
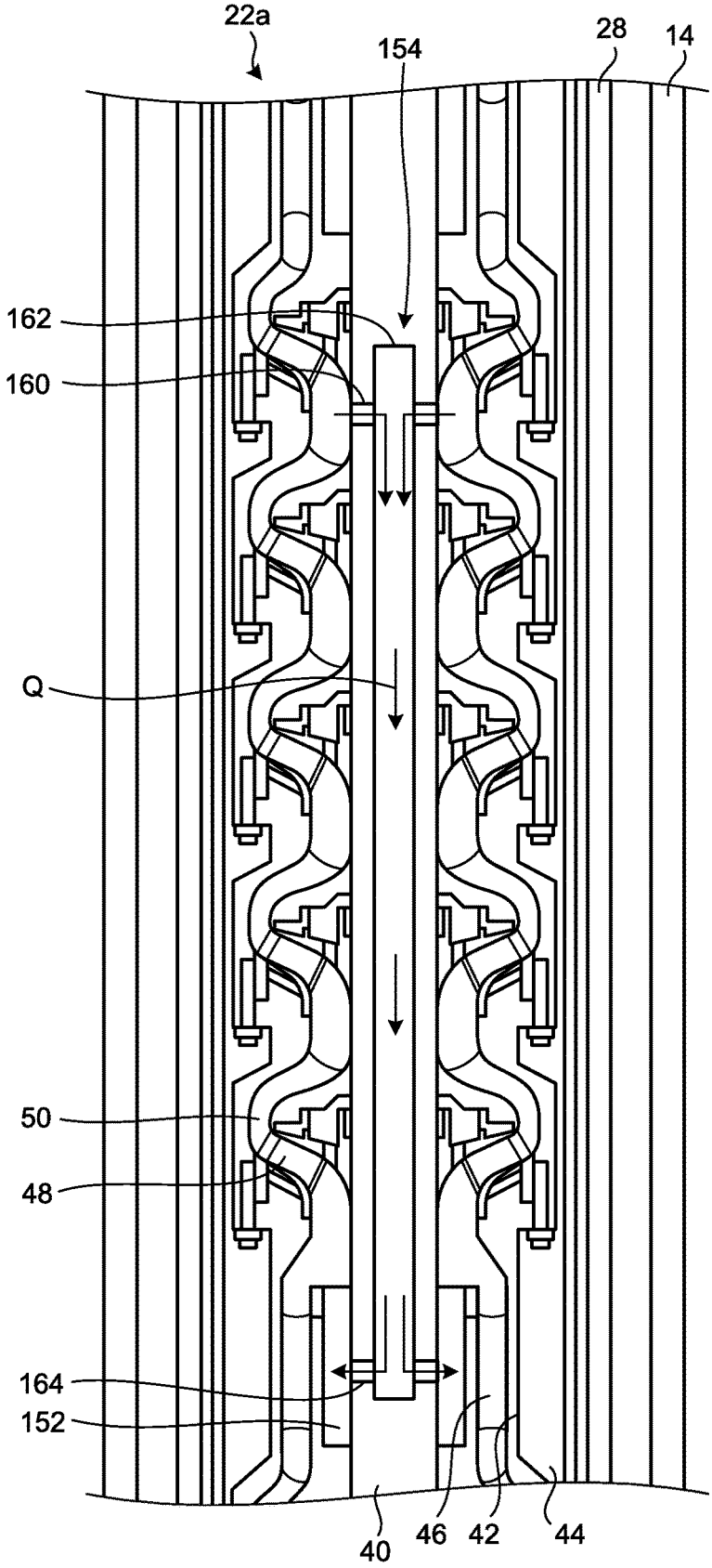
FIG. 11 is a fragmentary cross-sectional view illustrating another example of the pump body.

FIG. 11 is a cross-sectional view illustrating another example of the pump body. The basic structure of a pump body 22*a* illustrated in FIG. 11 is the same as the pump body 22*a*. The pump body 22*a* includes a rotor 40, a stator 42, and a casing 44. The pump body 22*a* includes a static pressure bearing 152 and a supply flow path 154. The static pressure bearing 152 is installed between the rotor 40 and the stator 42 further downstream than the multi-stage impellers 48 and the diffusers 50. The static pressure bearing 152 supplies the extraction oil Q at a predetermined pressure to the space between the rotor 40 and the stator 42 the same as the static pressure bearing 52, and receives the radial load.

The supply flow path 154 is installed in the inner area of the rotor 40. The supply path 154 includes a collection pipe 160, a rotor inner pipe 162, and a discharge pipe 164. The collection pipe 160 is open at the surface on the inner side in the radial direction of the flow path 46, and connects to the rotor inner pipe 162. The collection pipe 160 is open on the flow path 46 between the uppermost stage (stage furthest downstream) and the second stage of the multi-stage pump mechanism. The rotor inner pipe 162 is a pipe extending along the center of rotation of the rotor 40, and connects to the collection pipe 160 and the discharge pipe 164. The discharge pipe 164 connects to the rotor inner pipe 162 and the static pressure pocket of the static pressure bearing 52.

In the supply flow path 154, the pump body 22*a* collects a portion of the extraction oil Q flowing in the flow path 46 and supplies it by way of the rotor inner pipe 162 and the discharge pipe 164 to the static pressure bearing 152. In the pump body 22*a*, the difference between the pressure within the static pressure bearing 152 and the pressure of the extraction oil Q on the periphery of the static pressure bearing 152 can be increased by obtaining extraction oil Q that is supplied to the static pressure bearing 152 from the flow path 46 at a position after passing through a plurality of stages of the pump mechanism rather than the position that the static pressure bearing 152 is installed. The strength (rigidity) as a bearing can in this way be further increased.

In the pump body 22*a*, by installing the supply flow path 154 inside of the rotor 40, and connecting the collection pipe 160 to the inner side in the radial direction of the flow path 46, extraction oil Q flowing in the outer side in the radial direction, can flow into an area on the inner side in the radial direction by centrifugal force. In the extraction oil Q, solid material moving to the outer side in the radial direction within the flow path 46 can in this way be comparatively reduced on the inner side in the radial direction by applying centrifugal force. The mixing of solid material into the extraction oil Q flowing into the supply path 154 can in this way be made difficult to occur, and the mixing of solid material into the static pressure bearing 152 can be suppressed. The need for frequent maintenance of the static pressure bearing 152 can in this way also be reduced.

In the pump body 22*a* of the present embodiment, the case that the extraction oil Q is supplied to the static pressure bearing 152 in the perpendicular downstream direction (upstream side in flow direction of the flow path 46) of the multi-stage pump mechanism is described. However, the present invention is not limited to this example and the extraction oil Q collected in the supply path 154 may also be supplied to the static pressure bearing 52 of the above described pump 22.

The technical scope of the present invention is not limited to the above described embodiment and all manner of variations and modifications not departing from the aim of the present invention may be added.

REFERENCE SIGNS LIST

2 Installation surface
4 Oil field
10 Oil extraction device
12 Pump
14 Pipe
16 Ground facility
18 Guide pipe
20 Wire
22, 22*a* Pump body
24 Coupler
26 Motor
28 Stationary pipe
28*a* Inner circumferential surface
29 Electric cable
30, 40 Rotor
32, 42 Stator
44 Casing
46 Flow path
48 Impeller
50 Diffuser
52, 152 Static pressure bearing
54, 154 Supply flow path
60 Pipe part
62 Flange part
64 Land
66 Hole (oil path inlet)
68 Static pressure pocket
69 Bottleneck part
70 Path
72 Peripheral through holes

The invention claimed is:

1. An oil field pump installed within a pipe that connects to an oil field, the oil field pump being configured to feed accumulated extraction oil in a predetermined direction, the oil field pump comprising:

a rotor installed with a plurality of impellers installed along an axial direction of the rotor;

a stator installed on an outer circumference of the rotor so as to form a flow path for passing the extraction oil between the stator and the rotor, the stator including a diffuser on a downstream side of the impeller;

one static pressure bearing device installed between the rotor and the stator, the one static pressure bearing device supporting a load in a radial direction; and a supply flow path that supplies, to the one static pressure bearing device, a portion of the extraction oil flowing along an inner side in the radial direction of the flow path, wherein the one static pressure bearing device is installed further downstream than the impellers, and wherein the supply flow path is formed in the interior of the rotor.

2. The oil field pump according to claim 1, wherein the one static pressure bearing device is installed between the diffuser and the rotor.

* * * * *